United States Patent [19]

Bell, Jr.

[11] 4,305,417

[45] Dec. 15, 1981

[54] ROTATIONALLY INDEXING VALVE

[75] Inventor: William W. Bell, Jr., Marcellus, N.Y.

[73] Assignee: Carrier Corporation, Syracuse, N.Y.

[21] Appl. No.: 192,969

[22] Filed: Oct. 2, 1980

Related U.S. Application Data

[62] Division of Ser. No. 75,438, Sep. 13, 1979, Pat. No. 4,262,496.

[51] Int. Cl.[3] ..... F16K 31/12

[52] U.S. Cl. ..... 137/119; 137/624.14; 137/625.11

[58] Field of Search ..... 137/119, 624.14, 624.18, 137/625.11, 625.15, 625.16; 91/36, 536

[56] References Cited

U.S. PATENT DOCUMENTS 3,524,470 8/1970 Kah et al. ..... 137/119 X
3,924,652 12/1975 Kah ..... 137/625.11 X
3,995,494 12/1976 Muller ..... 137/625.11 X
4,253,494 3/1981 Cooke ..... 137/625.15 X

FOREIGN PATENT DOCUMENTS 1333105 10/1973 United Kingdom ..... 137/119

*Primary Examiner*—Robert G. Nilson
*Attorney, Agent, or Firm*—J. Raymond Curtin; Robert P. Hayter

[57] ABSTRACT

A rotationally indexing valve capable of directing refrigerant flow to various zones of a heat exchanger is disclosed. A piston is mounted for reciprocal movement within the valve casing. Means are provided for rotating the piston between selected positions as the piston reciprocates, each position connecting a valve port to a liquid chamber for directing flow therethrough.

6 Claims, 6 Drawing Figures

ROTATIONALLY INDEXING VALVE

This application is a division of application Ser. No. 75,438, filed Sept. 13, 1979, now U.S. Pat. No. 4,262,496.

DESCRIPTION

1. Background of the Invention

The present invention relates to a refrigeration circuit for transferring heat energy. More specifically, the present invention concerns apparatus and methods for selectively providing defrost of a portion of a heat exchanger and in conjunction therewith a valve mechanism for selecting the appropriate routing of refrigerant.

2. Description of the Prior Art

Air conditioners, refrigerators, heat pumps, and other devices utilizing a refrigeration circuit produce a controlled heat transfer by the selective evaporation and condensation of refrigerant under varying temperature and pressure conditions. A compressor may be used to increase the temperature and pressure of gaseous refrigerant. This refrigerant is then conducted to a condenser wherein under high pressure conditions the gaseous refrigerant is condensed into a liquid refrigerant. During this change from a gas to a liquid the refrigerant rejects its heat of condensation to a fluid circulated to the enclosure.

As in a typical heat pump this heat may be rejected through the heat exchanger to air to be heated and circulated to the enclosure.

Liquid refrigerant from the condenser undergoes a pressure change at an expansion valve or other expansion device such that the liquid refrigerant may be evaporated to a gaseous state absorbing heat energy. Typically, the evaporator is located adjacent the expansion device such that the liquid refrigerant changes to gaseous refrigerant within the evaporator at the lower pressure absorbing heat from ambient air in communication with the heat exchange surface of the evaporator. The amount of heat energy absorbed is equivalent to the heat of vaporization of the refrigerant. Gaseous refrigerant is then discharged from the evaporator to the compressor to begin the refrigerant cycle anew.

Additionally, there may be located within the refrigerant circuit a subcooler wherein liquid refrigerant is lowered in temperature below its saturation temperature. In a subcooler, heat is rejected from liquid refrigerant such that its overall temperture is decreased below the saturation temperature.

The outdoor heat exchanger of the air source heat pump is typically in communication with ambient air at a temperature lower than the temperature of the enclosure to be conditioned. When this ambient air approaches a temperature at which water will freeze then as the evaporator absorbs heat energy from the air, the air is cooled and moisture contained within the air is deposited on the outdoor coil heat exchange surfaces. Should the operating temperature of the outdoor heat exchanger together with the temperature and humidity conditions of the outdoor ambient air be appropriate, then the deposition of moisture on the outdoor heat exchange surface will result in said moisture freezing and an accumulation of frost occurring on the heat exchange surfaces.

Ice or frost acts to provide a thermal barrier for transfer of heat energy between the refrigerant and the outdoor air. Upon a sufficient buildup of frost it becomes necessary to remove the frost to provide for continued efficient operation of the refrigeration system. Additionally, the buildup of frost serves to narrow the openings between heat exchanger elements (typically fins) such that air flow therethrough is reduced further reducing the heat transfer capability of the outdoor heat exchanger. Consequently, it is necessary to provide some means of melting accumulated frost or preventing this frost accumulation on the outdoor heat transfer surfaces.

In conventional heat pump systems defrost is periodically initiated. The apparatus used to ascertain the appropriate time to initiate defrost is usually either timed or based upon a need for defrost. In any event, when the unit is cycled into the defrost mode of operation the system is reversed and heat energy is not supplied to the enclosure to be conditioned and may in fact be removed therefrom. This periodic reversal of the system acts to detract from the overall efficiency and further serves to negate the heating effect of the unit if indoor heat is utilized to melt the ice formed on the outdoor coil. If indoor heat is not utilized then typically electrical resistance heat which is more expensive serves to melt the ice formed on the outdoor coil.

In a conventional heat pump there are two primary methods of removing frost from the outdoor heat exchanger. A reversing valve may be added to the system such that the hot high temperature high pressure gaseous refrigerant discharged from the compressor is circulated to the outdoor heat exchanger wherein it is condensed rejecting its heat of condensation to the heat exchanger and thereby melting the ice formed on the surfaces of the heat exchanger. The second method is the provision of the alternative energy source such as electric resistance heat, radiant heat or fossil fuel heat which is conducted to the outdoor heat exchanger to raise its temperature above the melting temperature of the ice. Additionally, it is further known that liquid refrigerant may be conducted through the outdoor heat exchanger such that it is subcooled rejecting heat to melt the ice formed thereon.

The present invention concerns a refrigeration circuit as may be used in a heat pump or similar frost accumulating system wherein a heat exchanger is divided into a plurality of heat transfer zones. A selector valve is provided for conducting liquid refrigerant to one of the zones, said liquid refrigerant being subcooled in the zone rejecting heat to melt any accumulated frost on the heat exchange surfaces of said zone. The selector valve receives gaseous refrigerant from the remaining zones and routes that refrigerant back to the compressor. Consequently one zone of the heat exchanger is acting as a subcooler and the remaining zones are acting as evaporators. A header, check valve and expansion device arrangement is utilized to provide appropriate routing between the zone used for subcooling and evaporator zones.

The present invention has a continually operating system such that a single zone acts as a subcooler for melting ice. This single zone is cycled among the zones of the heat exchanger such that all are periodically melted. However, by providing a zone which acts as a subcooler the rejection of heat energy to melt ice is utilized to increase the overall efficiency of the refrigeration system. By subcooling liquid refrigerant in a zone rejecting heat to melt the ice the refrigerant expanded into the other zones acting as evaporators is at a lower temperature and consequently is capable of absorbing more heat energy than if it were not subcooled. Hence, the system disclosed and claimed herein not only provides for continual nonreverse operation but allows for defrosting of a coil without substantially impairing the efficiency of the system by requiring either reversal of operation or additional heat energy input.

A selector valve is described and claimed herein having a main piston which reciprocates within a valve casing such that the main piston is indexed between various valve ports for conducting liquid refrigerant to the appropriate zone and receiving gaseous refrigerant from the remainder of the zones. A spring biased tube is used to provide a seal upon indexing such that the high pressure liquid refrigerant entering the valve from the condenser is separated from the low pressure gaseous refrigerant entering the valve from the zones of the outdoor heat exchanger serving as evaporators.

SUMMARY OF THE INVENTION

It is an object of the present invention to provide an improved refrigeration circuit for the transfer of heat energy utilizing a heat exchanger upon which frost may accumulate.

A further object of the present invention is to provide a valve for selectively cycling refrigerant flow between zones of an outdoor heat exchanger.

It is a further object of the present invention to provide a heat pump refrigeration system wherein the outdoor heat exchanger is continually defrosted without substantially impairing the efficiency of the system and without requiring reverse type operation for defrost.

Another object of the present invention is to provide a safe economical and reliable heat pump system including means for defrosting a segment of the outdoor heat exchanger while utilizing the remaining segments as evaporators and further including a selector valve for providing the appropriate flow through these zones such that a highly efficient heat transfer system is provided.

These and other objects are achieved according to the preferred embodiment of the present invention by a heat pump system having an outdoor heat exchanger divided into a plurality of heat transfer zones. A selector valve is provided to receive liquid refrigerant from the indoor heat exchanger and to discharge said liquid refrigerant into at least one of the zones of the outdoor heat exchanger. The selector valve simultaneously receives gaseous refrigerant from the remainder of the zones of the outdoor heat exchanger and conducts same back to the compressor of the refrigeration circuit. A header, check valve and expansion device arrangement is provided such that the liquid refrigerant entering the zone of the outdoor heat exchanger wherein subcooling occurs is then routed to the remaining zones of the outdoor heat exchanger acting as evaporators. Between the subcooling zone and remaining zones the refrigerant undergoes a pressure drop by passing through an expansion device.

The selector valve as disclosed herein has a piston through which high pressure liquid refrigerant flows. This piston includes a sealing tube for providing a seal with one of the valve ports connected to the heat exchanger zones. The remainder of the valve ports are connected to receive gaseous refrigerant and discharge same to the compressor. A spring is mounted to balance pressure against the main piston, said pressure originating from the high pressure refrigerant flowing therethrough. Means to index the valve as a result of its reciprocation within the casing are further provided. A liquid line valve may be used to interrupt the flow of liquid refrigerant to the valve causing the piston to reciprocate within the casing and consequently to rotate indexing between the various valve ports and consequently changing the zone of the heat exchanger being used as a subcooler.

DESCRIPTION OF THE PREFERRED EMBODIMENT

The hereinafter described heat pump system is shown as a nonreversible system. It is to be understood that the present invention may be applied to reversible and similar systems or combinations thereof. It is to be additionally understood that although this refrigeration system is shown utilizing a compressor other types of refrigeration systems wherein refrigerant is evaporated at a temperature at which frost may accumulate on a heat exchanger may likewise utilize apparatus as claimed herein. Additionally, the herein disclosed apparatus and system are not limited to reverse cycle or heat pump refrigeration circuits but are also applicable to any refrigeration circuit having a heat exchanger upon which frost may accumulate.

Additionally, claimed herewith is a selector valve for indexing refrigerant flow between the various zones of the outdoor heat exchanger. It is to be understood that the selector valve as claimed herein is but one embodiment which might serve the purpose intended. For the overall system any valve which achieves the results of the claimed valve would be equally satisfactory. Additionally, the number of zones of the outdoor heat exchanger is a matter of design choice. Naturally, the number of zones will affect the overall amount of subcooling that occurs.

Figure 1:
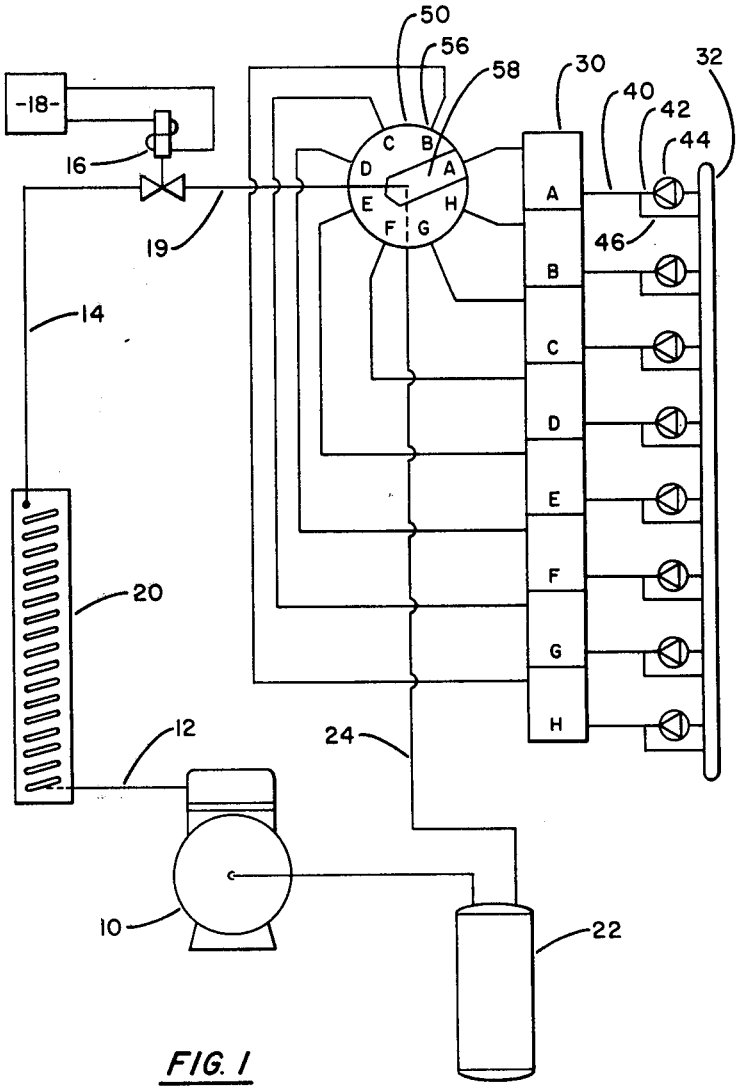
FIG. 1 is a schematic view of a heat pump system including the selector valve and heat exchanger of the present invention.

Referring now to FIG. 1 there can be seen a vapor compression refrigeration system. Compressor 10 which serves to increase the temperature and pressure of gaseous refrigerant is connected by vapor line 12 to indoor heat exchanger 20. Within the indoor heat exchanger 20 the gaseous refrigerant from the compressor is condensed to a liquid and in the process rejects its heat of condensation. This rejected heat energy is then used to heat the enclosure or another end use. Connected to indoor heat exchanger 20 is liquid line 14. Liquid line 14 serves to conduct liquid refrigerant from the indoor heat exchanger 20 to the liquid line solenoid valve 16. Timer 18 is electrically connected between a source of energy and liquid line solenoid valve 16 such that the timer periodically acts to have the liquid line solenoid valve interrupt the flow through liquid line 14. Line 19 connects liquid line solenoid valve 16 with selector valve 50. Line 19 enters selector valve 50 at valve inlet port 52.

Suction line 24 connects valve discharge 54 of selector valve 50 with accumulator 22. Accumulator 22 is connected to compressor 10.

As can be further seen in FIG. 1, outdoor heat exchanger 30 is divided into zones A through H. Each of these zones is shown as a separate heat exchanger having an inlet and an outlet. Selector valve 50 is shown having valve ports 56 spaced about the circumference thereof. These valve ports are labelled A through H, each corresponding with the zone to which it is connected. Additionally shown within selector valve 50 are main piston 60 and liquid chamber 58 which conducts the liquid refrigerant received from the indoor heat exchanger to the zone which will act as a subcooler. As shown in FIG. 1 it can be seen that liquid chamber 58 is arranged so that zone A will be acting as the subcooler. Header 32 is shown connected to check valves 44 and capillary tubes 46. Lines 40 serve to connect the zones of the heat exchanger to Y-tubes 42 such that check valves 44 and capillary tubes 46 are in parallel as concerns the flow of refrigerant between the zone and the header. Each zone A through H has a line 40, a Y-tube 42 and its appropriate check valve and capillary all connected to header 32.

Operation

When the heat pump system is operated the condensed liquid refrigerant at high pressure from the indoor heat exchanger is routed into selector valve 50 at valve inlet 52. This high pressure liquid refrigerant is then conducted as shown in FIG. 1 through liquid chamber 58 and discharged out of selector valve 50 at valve port 56A through line 54A to zone A of the outdoor heat exchanger. Liquid refrigerant is then subcooled in zone A rejecting heat to melt any frost accumulated on the heat exchange surface of zone A. The subcooled liquid refrigerant is then conducted from zone A through line 40 into Y-tube 42. Subcooled refrigerant then flows through check valve 44 into header 32. The now subcooled liquid refrigerant within header 32 will then pass through capillary tubes 46 corresponding to zones B, C, D, E, F, G and H into each zones appropriate Y-tube and line 40 such that all of said zones B through H receive refrigerant at a lower pressure and may then act as evaporators. In each of these zones said refrigerant is evaporated absorbing heat energy from the outdoor ambient air in heat exchange relation therewith and is then conducted through appropriate line 54 to selector valve ports 56B through 56H. Gaseous refrigerant is the conducted out of selector valve 50 through valve discharge 54 to suction line 24 and back to the compressor. Consequently, a closed heat pump system has been provided where with the combination of a selector valve, an outdoor heat exchanger divided into zones and an assembly including a header, check valves and expansion devices, it is possible to continuously subcool refrigerant within a zone and to use the remaining zones of the outdoor heat exchanger as evaporators. By indexing the selector valve the zone being subcooled may be cycled such that each zone is periodically defrosted.

The utilization of a zone as a subcooler further serves to increase the efficiency of the refrigeration system since the liquid refrigerant prior to expansion into the evaporator zones is subcooled. Subcooled refrigerant is at a lower temperature and therefor able to absorb more heat energy during vaporization in the evaporator.

Valve Description

As can be seen in FIGS. 2 through 6, a specific valve configuration has been provided to serve the function of selector valve 50 as shown in FIG. 1.

Figure 3:
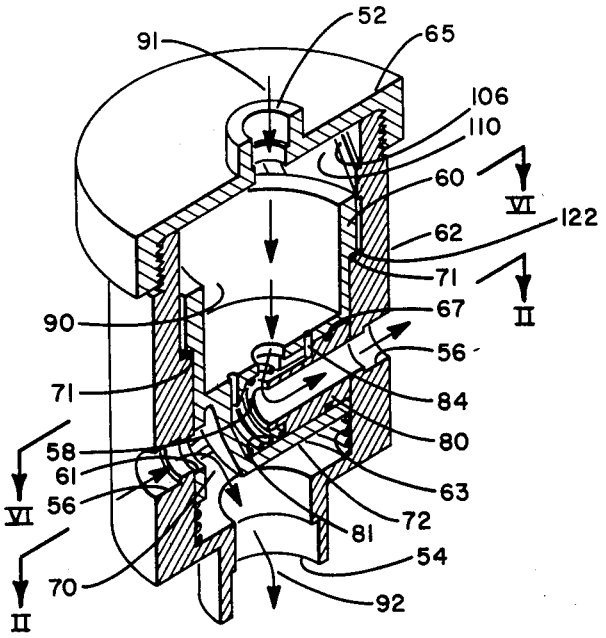
FIG. 3 is a sectional view of the selector valve.

Referring first to FIG. 3, it can be seen that a valve is formed by casing 62 and cap 65. Cap 65 may be rotatably secured to casing 62 to form the valve enclosure. The valve inlet 52 is provided through cap 65 such that liquid refrigerant may enter therein. Valve discharge 54 is provided at the bottom of the valve through casing 62 and provides an opening for the discharge of gaseous refrigerant to the suction line leading to the compressor. Mounted about the periphery of casing 62 are valve ports 56A through 56H. These eight ports are spaced equally and circumferentially about the casing, each of said ports connecting to the appropriate distributor line A through H which is connected to the appropriate outdoor heat exchanger zone A through H. Piston 60 is located within the casing such that it may reciprocate in a top to bottom direction. Piston 60 defines therethrough a flow path for liquid refrigerant indicated by arrows 91 in FIG. 3. Liquid refrigerant enters through valve inlet 52 and flows into liquid chamber 58 defined by piston 60. Mounted within liquid chamber 58 are spring 81, seal tube 80 which may be made from a material adapted to form a good seal such as a suitable plastic, pin 84 and O-ring 67. Seal tube 80 is mounted to reciprocate as shown in FIG. 3 in a horizontal direction such that it may be used to provide a tight seal between the interior surface of the casing surrounding a valve port and the liquid chamber through O-ring 67. Consequently, flow path 91 includes flow through the center of the piston and through the center of the seal tube out valve port 56. A pin 84 is provided extending from piston 60 such that pin slot 82 of the seal tube 80 is engaged thereby to limit the motion of the seal tube. Spring 81 is provided to force the seal tube against the interior surface of the casing to aid in providing a tight seal. O-ring 67 is provided between the exterior surface of the seal tube and the surface of the piston to further prevent flow between high pressure regions and low pressure regions of the valve. O-ring 71 located between the main piston and the casing serves a similar purpose. Cavity 90 defined by piston 60 is utilized to impress a force on piston 60 driving it downwardly as shown in FIG. 3 by the provision of a cavity containing high pressure fluid. Should the flow of high pressure fluid be interrupted then the force exerted by the fluid in cavity 90 will be eliminated.

Figure 2:
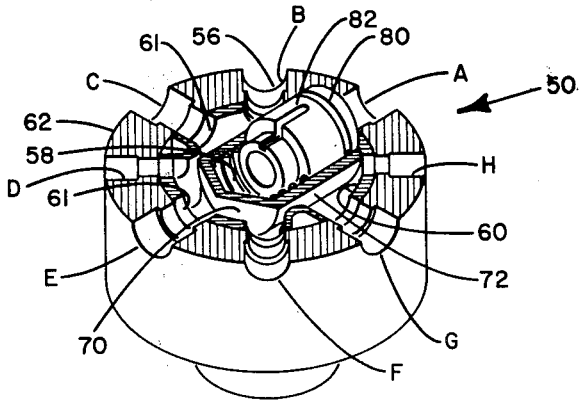
FIG. 2 is a cross-sectional view of FIG. 3 taken along line II—II therein.

Valve discharge 54 is located at the bottom of casing 62 and acts to discharge gaseous refrigerant at a low pressure to the suction line to the compressor. Valve ports 56 not connected to the high pressure source through the piston 60 all are connected to valve discharge 54 such that gaseous refrigerant may be withdrawn from each of the zones of the outdoor heat exchanger not being used as subcooler. This gaseous refrigerant enters through valve ports 56 B through H as shown in FIGS. 2 and 3, then travels through piston orifices 61 (openings formed through piston 60), then travels into gas chamber 70 being that portion of the interior of the valve formed between the bottom of the casing 62 and the bottom of piston 60 and then out of valve discharge 54. The flow path of the gaseous refrigerant is indicated by arrows referenced by numeral 92.

Piston spring 63 shown located within gas chamber 70 serves to bias the piston in an upwardly direction against the force applied downwardly by the high pressure fluid acting through cavity 90 on the top surfaces of the piston.

Referring specifically to FIG. 2, a cross-sectional view of FIG. 3 at line II—II it can be seen that the liquid chamber 58 is adapted to be rotated to place same in communication with any of the valve ports 56 A through H. Pin slot 82 shown extending within seal tube 80 prevents said tube from becoming misaligned. Main piston 60 together with orifices 61 defined thereby may be seen in FIG. 2 such that the relationship between location of the piston and the liquid chamber formed therein may be seen. Piston skirt 72 defining a portion of the liquid chamber is also shown. Location of the gas chamber beneath and about the piston skirt and communicating valve ports through the piston orifices is also shown.

Formed extending inwardly from inner surface 110 of casing 62 are angled deflectors 106. Casing 65 also has casing lip 120 from which casing teeth 102 extend upwardly. Piston 60 has piston lip 122 which mates with casing lip 120 and has extending downwardly therefrom piston teeth 100. Piston teeth 100 mesh with casing teeth 102 to secure the piston from further top to bottom motion and to assure that the sealing tube is positioned correctly about a port 56. Piston projection 104 extends outwardly from the piston such that upon appropriate piston displacement the piston projection engages angled deflector 106 of the casing.

Figure 4:
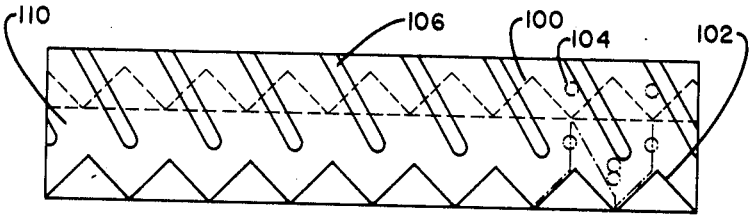
FIG. 4 is a planar layout view of the indexing mechanism within the valve shown with the piston in the raised position.
Figure 5:
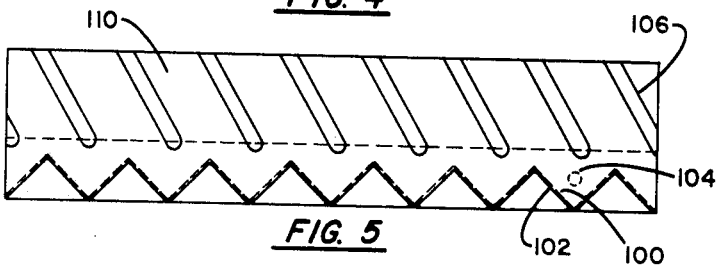
FIG. 5 is a planar layout view of the indexing mechanism within the valve with the piston in the at rest position.
Figure 6:
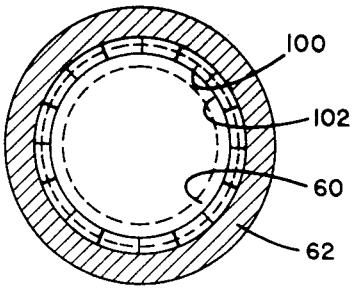
FIG. 6 is a cross-sectional view of FIG. 3 taken along line VI—VI therein.

FIG. 4 shows a planar schematic view of casing teeth 102, piston teeth 100, casing deflectors 106 and piston projection 104 when the piston is in the raised position. FIG. 5 is the same view with the piston in the lowered position. FIG. 6 is a cross-sectional view showing the relative positions of the casing, piston, piston teeth and casing teeth.

Operation

During steady state flow opertions high pressure refrigerant enters through valve inlet 52 flows through the center of the piston into liquid chamber 58 through the center of seal tube 80 and is discharged through a valve port 56 to the appropriate section of the outdoor heat exchanger. The high pressure refrigerant serves to exert a force to hold the piston in a downward position compressing piston spring 63. The remaining valve ports 56 receive gaseous refrigerant from the evaporator zones of the outdoor heat exchanger, said gaseous refrigerant being conducted through piston orifices 61 through the gas chamber 70 and then being discharged through valve discharge 54.

When it is desirous to index the valve such that the zone of the outdoor heat exchanger being subcooled is changed, the liquid flow to the valve is interrupted. This interruption of flow allows the pressure of the fluid in cavity 90 to decrease such that it exerts a reduced downward force on piston 60 and piston spring 63 is then capable of forcing the piston 60 upwardly. Piston 60 remains in an upwardly position until high pressure refrigerant flow is resumed at which point high pressure fluid in cavity 90 will again act to force the piston downwardly. Consequently, each interruption in refrigerant flow results in a two step upward and downward motion which indexes the valve such that liquid chamber 58 moves from being in communication with valve port 56A to valve port 56B, etc. This interruption in liquid refrigerant flow may be accomplished utilizing a timer 18 and a liquid line valve 16 as is shown in FIG. 1. Of course other methods of flow interruption may be equally efficient.

During the upward motion of piston 60 projection 104 extending from the piston engages casing deflector 106. As the piston moves upwardly the projection is displaced by the casing deflector and the piston is partially rotated. Once the piston is at its full up position and thereafter travels downwardly the piston projection loses contact with casing deflector 106. As the piston moves further downward the piston teeth engage the casing teeth and further downward motion results in the piston rotating until the teeth fully mesh. As is seen in FIGS. 4 and 5, this means that projection 104 travels upwardly until it engages casing deflector 106 and then upwardly and to the left at it follows the casing deflector. The rotation in the upward direction is sufficient that when the piston moves downwardly the piston teeth engage the casing teeth such that when the piston is in the lowered position the teeth mesh and the valve is indexed from one port to the adjacent port. The teeth serve to locate the sealing tube relative to the ports.

It is obvious from the above description that a valve for use in conjunction with the heat pump system previously described has been provided. This valve is capable of indexing high pressure liquid refrigerant flow between zones and simultaneously receiving gaseous low pressure refrigerant discharge from the remaining zones. Naturally, similar valves accomplishing the same purpose can be utilized with the system.

The invention has been described in detail with particular reference to preferred embodiments thereof but it will be understood that variations and modifications can be effected within the spirit and scope of the invention.

I claim:

1. A valve which comprises:

a generally cylindrical casig having a discharge port and a plurality of valve ports spaced about the circumference of the casing a cap which is adapted to form a closed container with the casing, said cap having an inlet port a piston mounted to reciprocate within the container, said piston having a liquid chamber in communication with the inlet port and at least one of said valve ports whereby fluid introduced into said valve through the inlet may flow directly to the one of said valve ports means to rotationally index the piston between preselected positions as it reciprocates within the container, the liquid chamber of said piston being in communication with different valve ports at different indexed positions means communicating the valve ports not in communication with the liquid chamber with the discharge port, and means to provide a seal between the liquid chamber of the piston and a valve port formed in the casing, said means being further adapted to reciprocate and be rotationally indexed with the piston.

2. The apparatus as set forth in claim 1 wherein the means to provide a seal comprises a sealing tube and a spring, said spring acting to bias the sealing tube against the inner surface of the casing, said tube being located within the liquid chamber and having a longitudinally extending opening for flow therethrough.

3. The apparatus as set forth in claim 1 wherein the means to rotationally index the valve includes:

a cavity defined by the cap, casing and piston, said cavity receiving high pressure fluid from the inlet port and acting to force the piston toward the discharge port a gas chamber defined by the piston and a bottom portion of the casing having therein the discharge port a spring mounted within the gas chamber and acting to bias the piston away from the discharge port at least one casing deflector formed as part of the casing, and a piston projection extending from the piston coacting with the casing deflector to force the piston to rotate as it reciprocates.

4. The apparatus as set forth in claim 3 wherein the cavity is sized to force the piston toward the discharge port and to hold the piston in that position when high pressure fluid is entering through the inlet port, and wherein upon a discontinuance of the flow of high pressure fluid the piston is displaced upwardly by the spring since the pressure exerted against the piston has been eliminated, whereby a complete reciprocation cycle occurs upon the fluid flow commencing and terminating.

5. The apparatus as set forth in claim 4 and further including casing teeth extending from the casing and piston teeth extending from the piston, said teeth coacting to secure the sealing tube in relation to a valve port.

6. A valve which comprises:

a casing having a discharge port located at the bottom for discharge of refrigerant and having a plurality of valve ports spaced about the outer surface of the casing;

a cap including an inlet port which is adapted to be fastened to the top of the casing for forming a closed container;

a piston mounted to reciprocate within the casing, said piston having a liquid chamber in communication with both the inlet port and a single valve port, having at least one piston orifice for communicating the remaining valve ports with the discharge port and having a rotation portion with a projection extending therefrom;

a sealing tube mounted in the liquid chamber of the main piston having an opening therethrough for refrigerant to flow through and being biased by a spring to abut against the inside of the casing about the periphery of a valve port such that said valve port may be at a pressure level different from other ports;

said casing defining a gas chamber between the bottom of the main piston and the discharge port;

a spring located in the gas chamber and attached to bias the main piston upwardly;

a cavity defined by the cap and casing in communication with the flow path through the valve, said cavity being adapted to receive high pressure fluid such that said fluid exerts a downward force on the main piston acting to compress the spring;

at least one casing deflector extending inwardly from the casing, said casing deflector being angled from the direction of reciprocation of the piston; and a rotation driver portion of the main piston, said driver portion having a projection extending therefrom to coact with the casing deflector of the casing whereby upon the piston reciprocating upwardly and downwardly with line pressure fluctuations said piston is rotated causing the sealing tube to index between valve ports.

* * * * *